United States Patent [19]

Wilston

[11] Patent Number: 5,003,746

[45] Date of Patent: Apr. 2, 1991

[54] ARCUATE AND CURVILINEAR ASSEMBLIES COMPRISING TANDEMLY ARRANGED BUILDING BLOCKS HAVING DEGREES OF ROTATION

[75] Inventor: Arthur Wilston, Troy, Pa.

[73] Assignee: Structural Block Systems, Inc., Troy, Pa.

[21] Appl. No.: 532,849

[22] Filed: May 31, 1990

Related U.S. Application Data

[63] Continuation of Ser. No. 267,903, Nov. 7, 1988, abandoned.

[51] Int. Cl.[5] ..... B37B 1/04

[52] U.S. Cl. ..... 52/589; 52/608

[58] Field of Search ..... 52/606, 608, 593, 589, 52/245; 446/127; 405/285, 286, 31, 33

[56] References Cited

U.S. PATENT DOCUMENTS

| | | | |
|---|---|---|---|
| 1,958,799 | 5/1934 | Playford | 52/589 |
| 2,780,150 | 2/1957 | Yeoman | 52/593 |
| 2,877,506 | 3/1959 | Almoslino | 52/227 |
| 3,102,367 | 9/1963 | Pederson et al. | 52/245 |
| 4,183,454 | 1/1980 | Snell | 52/593 |

FOREIGN PATENT DOCUMENTS

| | | | |
|---|---|---|---|
| 2239988 | 2/1974 | Fed. Rep. of Germany | 52/608 |

*Primary Examiner*—David A. Scherbel
*Assistant Examiner*—Michele A. Van Patten
*Attorney, Agent, or Firm*—Salzman & Levy

[57] ABSTRACT

The invention features repeating building block units of generally rectilinear shape, which have arcuate mating end wall surfaces that are rotatable with respect to each other.

Curvilinear surfaces of varying degrees of arc can be formed from a tandem array of the block units, such that assemblies of many different shapes can be fabricated.

11 Claims, 2 Drawing Sheets

ARCUATE AND CURVILINEAR ASSEMBLIES COMPRISING TANDEMLY ARRANGED BUILDING BLOCKS HAVING DEGREES OF ROTATION

This is a continuation of co-pending application Ser. No. 07/267,903 filed on Nov. 7, 1988, now abandoned.

FIELD OF THE INVENTION

The invention relates to building blocks both for toys and construction, and more particularly to a building block that can be assembled to provide arcuate structures of varying curvilinear dimensions and designs.

BACKGROUND OF THE INVENTION

Building blocks for making arcuately-shaped assemblies are known. One such building block for making curved assemblies is illustrated in U.S. Pat. No. 2,877,506; issued: Mar. 17, 1959; to: H. A. Almoslino.

While this patent describes a building block of simple construction, it is not possible to create a curved structure of different angle or curvilinearity without changing the shape or curvature of the building block itself.

Having building blocks which require a change of shape or dimensions, limits their usefulness and increases production costs.

Usually odd-shaped and/or curved blocks are not useful for straight wall construction, or for structures having perpendicular corners. Intricately shaped blocks slow down production, because time must be spent in arranging the blocks to achieve the desired pattern or shape of the assembly.

It is preferable to use building blocks which are generally rectangular or rectilinear in shape, since this is the most commonly used unit form. Construction workers and masons feel more comfortable in fabricating walls and other structures with standard-shaped blocks.

The invention is predicated on the concept that curved or arcuate-shaped assemblies can be achieved using the standard, generally rectilinear block unit.

Each building block of the invention is generally of the same shape, so that production and labor costs are minimized.

One of the many advantages provided by the invention is the ability to change the curvature of a wall over a wide range of arc.

Concave and convex shapes are possible in the same assembly due to the versatility of the building block of the invention.

Another important advantage of the invention is the ability of the same block unit to provide straight wall, as well as curved wall assemblies.

Still another advantage of the invention is the ability of the mating end walls of adjoining blocks to resist separation under lateral forces typical of those produced during earthquakes.

SUMMARY OF THE INVENTION

The invention pertains to a building block, which is one of a plurality of other such building blocks. The building blocks are designed to be arranged in a tandem array, and are utilized to fabricate and construct curved or arcuate assemblies. The building block is generally rectilinear with the exception of two oppositely disposed distal end walls which feature arcuate male and female mating surfaces, respectively. Each of the end walls is rotatively engageable with an arcuate mating end wall of an adjacent block of the assembly. Each of the end walls successively mates in the tandem array at any desired rotative angle with respect to each other within a limited range of arc defined by the circumferential end abutments terminating the arcuate surfaces of the mating end walls.

The arcuate end walls are generally semi-circular in shape, and have a radius approximately equal to half of the width of the block.

Each block has an aperture in a mid-portion for receipt of a reinforcement plug. Each plug has a lattice network of grooves for receipt of reinforcing rods.

The plug has a circular cross-section and tapered sides. A lip disposed in a mid-section of the plug limits its depth within the block aperture.

Another aperture disposed within the arcuate male end wall can carry or support cylindrical pipes or additional vertical reinforcements.

BRIEF DESCRIPTION OF THE DRAWINGS

A complete understanding of the present invention may be obtained by reference to the accompanying drawings, when taken in conjunction with the detailed description thereof and in which.

DESCRIPTION OF THE PREFERRED EMBODIMENT

Generally speaking, the invention features a building block unit that can be utilized as a toy or in actual building construction. The building block unit of the invention is generally rectilinear, and can be utilized to fabricate arcuate or curved assemblies of different arcs of curvature.

For the purposes of brevity, individual elements will bear the same designation throughout the figures.

Figure 1:
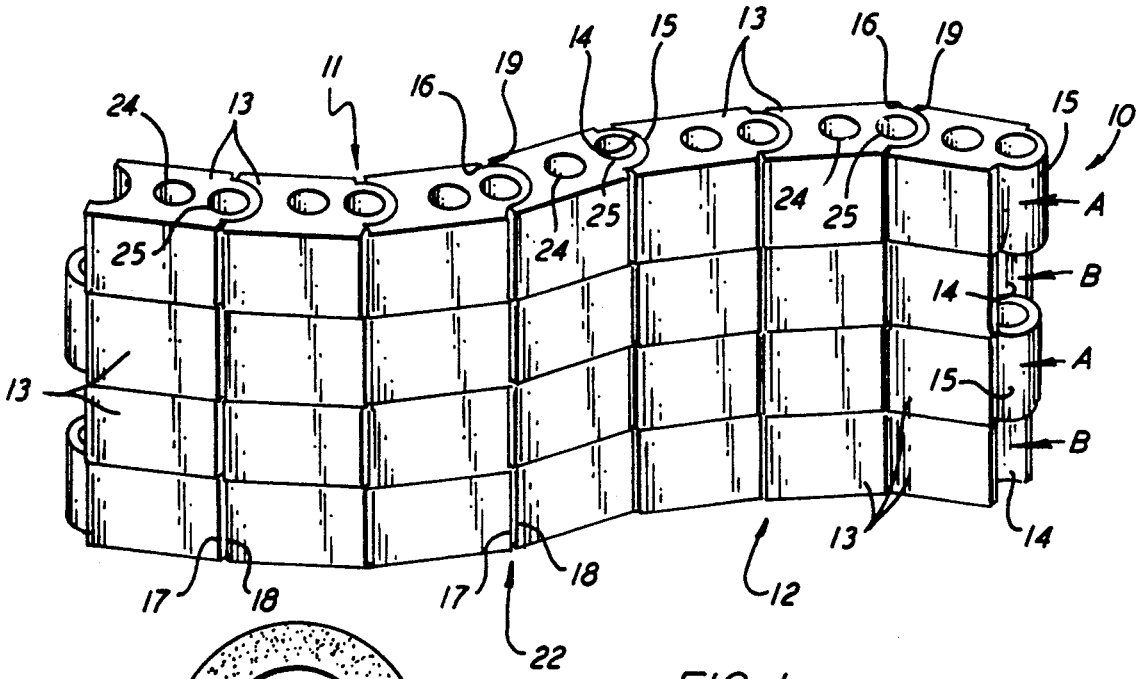
FIG. 1 is a perspective, in situ view of a partial wall assembly fabricated with the building blocks of the invention.

Now referring to FIG. 1, an arcuate wall assembly is shown by arrow 10. The wall assembly has both a convex portion (arrow 11) and a concave portion (arrow 12). The wall assembly 10 is comprised of alternating rows "A" and "B", respectively, of repeating block units 13. Rows "A" are a tandem array of block units 13 which have a convex end wall 15 facing towards the right, while rows "B" are a tandem array of block units 13 having a concave end wall 14 facing towards the right.

Figure 2:
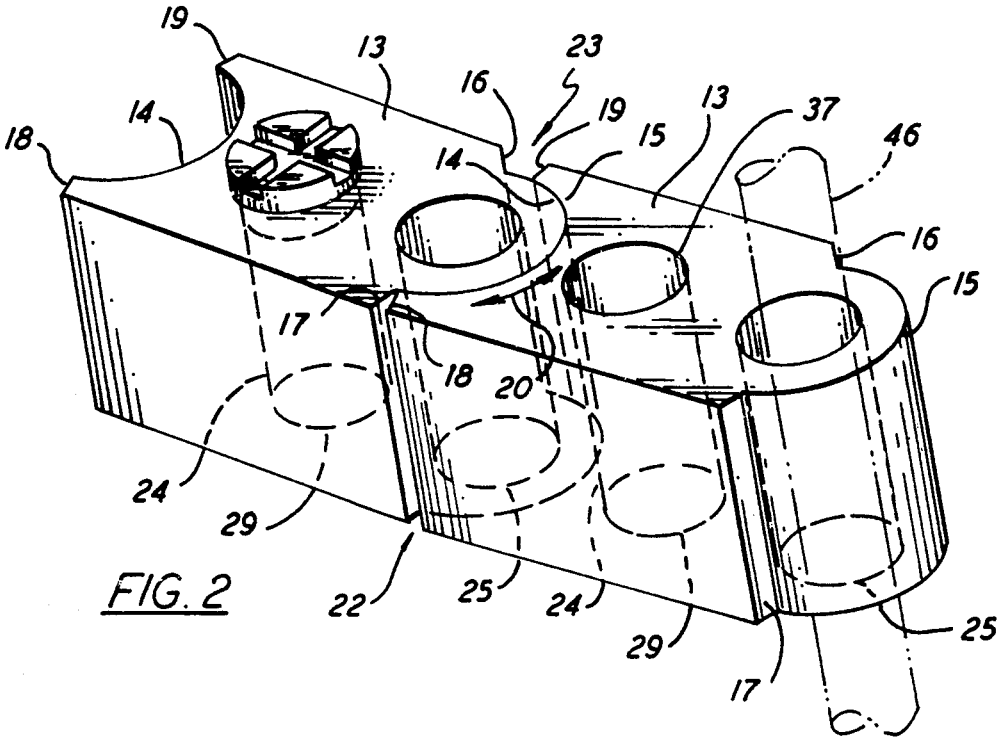
FIG. 2 is a perspective view of a partial mating two block unit of the wall assembly of FIG. 1.
Figure 3:
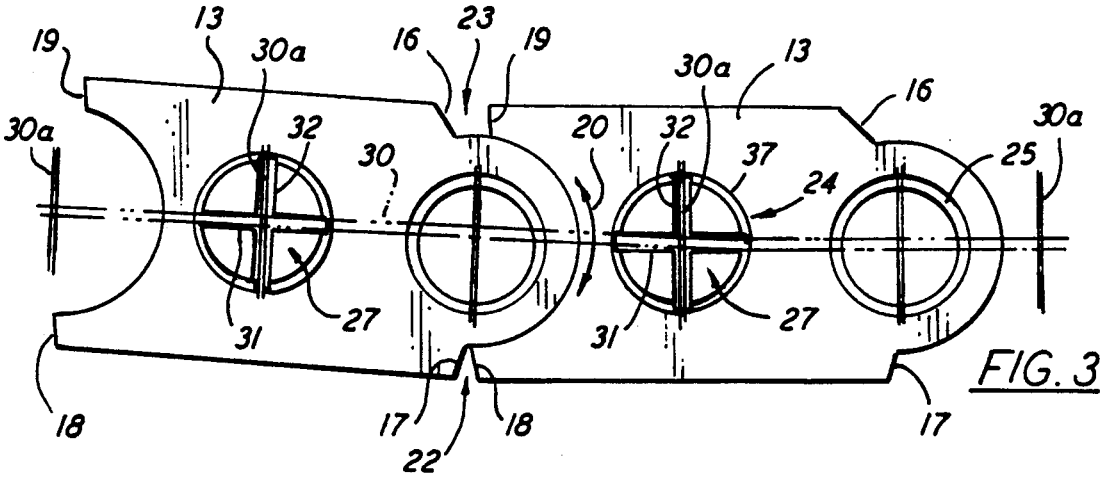
FIG. 3 is a top view of the two block unit of FIG. 2.

Each block unit 13 is shown in greater detail with reference to FIGS. 2 and 3.

In FIGS. 2 and 3, two block units 13 are shown in mating engagement. Each unit 13 is generally rectilinear with the exception of concave end wall 14 and convex end wall 15. End walls 14 and 15, respectively mate with each other, thus providing a continuous tandem array. Each row of blocks are stacked upon another row of blocks in alternating "A" and "B" rows until a wall assembly 10 is achieved, as illustrated in FIG. 1.

Because of the mating arcuate surfaces presented by the end walls 14 and 15, each block unit 13 is rotatable with respect to its adjacent mating block unit 13. Thus, a wall assembly 10 can be constructed with an arcuate profile. The degree of rotation (arrow 20) or length of arc is limited only by the end wall abutments 16, 17, 18 and 19, respectively. Abutments 17 and 18 are respectively aligned with the radial center of their respective end walls 15 and 14, which allows for vertical alignment of gaps 22 as the wall 10 grows in height.

Referring to FIG. 1, it will be noted that when end walls 14 and 15 are rotated with respect to each other, the gaps 22 and 23, respectively between the abutments 16 and 19; and 17 and 18 will increase/decrease in gap width or vice versa as the case may be. The gaps 22 and 23 may be filled with mortar to smooth over the wall surface, or may be left unfilled as part of a design.

Figure 4:
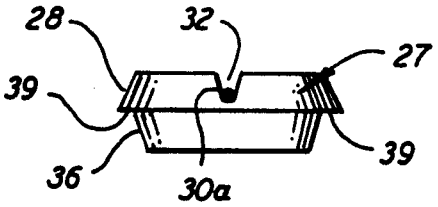
FIG. 4 is a front view of a reinforcement plug shown in FIGS. 2 and 3.
Figure 5:
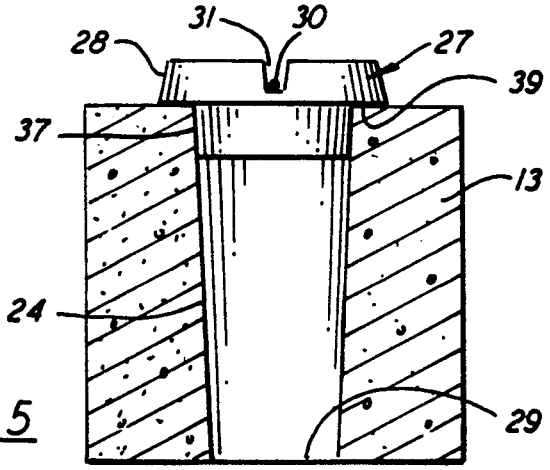
FIG. 5 is a partial sectional view of the building block unit illustrated in FIG. 2.

Each building block unit 13 has two apertures 24 and 25 extending completely through the block from top to bottom. Aperture 25 can support a cylindrical pipe or column 46, as shown in phantom in FIG. 2. The aperture 24 is designed to receive a plug 27 more clearly depicted in FIGS. 3 through 5. Plug 27 can serve several purposes:

(1) as a spacing element between blocks that are stacked one on top of the other; or (2) as a means to locate and position the overhead block in the array since the top edge 28 is tapered to fit within the bottom edge 29 (FIG. 2) of aperture 24 of the next stacked block unit 13; or (3) as a means to receive a reinforcing bar or rod or wire 30 (shown in phantom in FIG. 3) so as to space blocks with respect to one another and so as to reinforce each of the blocks.

Reinforcing wire 30 has cross wires spaced at predetermined distances along its length, as shown at reference numeral 30*a*. These cross wires 30*a* are part of a unitary structure formed at the same time as reinforcing wire 30 in the preferred embodiment. It should be understood, however, that cross wires 30*a* can also be attached to reinforcing wire 30 at a later time by welding or other suitable means. Cross wires 30*a* are generally disposed perpendicular to reinforcing wire 30 in the preferred embodiment. Wires 30 and 30*a* fit in the lattice network grooves 31 and 32, respectively, disposed in plug 27. The reinforcing wire 30 can be utilized to tie adjacent blocks or rows of block units 13 together, either longitudinally and/or laterally. The plug 27 has a lower tapered edge 36 (FIG. 4) to locate the plug in the top edge 37 of aperture 24. The lip 39 of plug 29 limits the depth to which plug 27 can descend into aperture 24.

Figure 6:
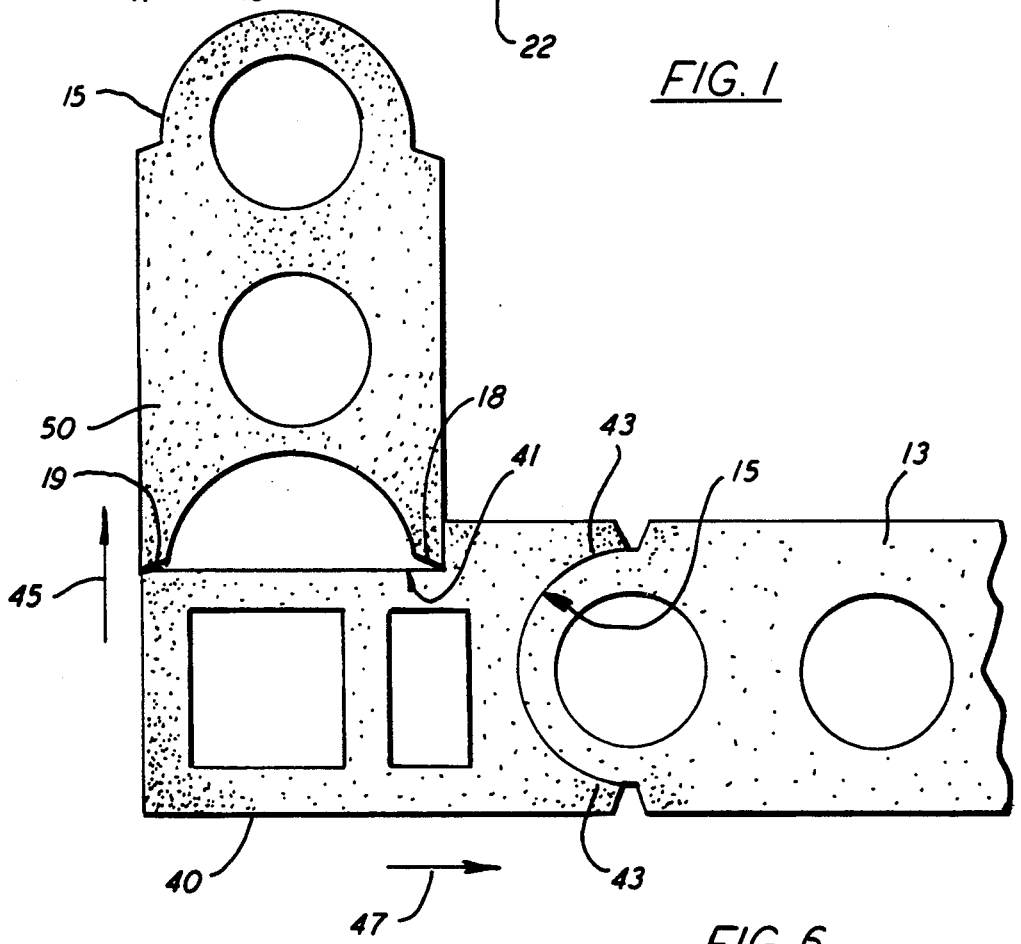
FIG. 6 is a plan view of a modified block assembly for fabricating rectilinear corner structures.

Referring to FIG. 6, a perpendicular corner can be formed by utilizing two block units 40 and 50. Block unit 40 has a concave end wall abutment 43, which will mate with the convex end wall 15 of a standard block unit 13, in order to start the tandem array. Block unit 40 also has a recess 41 which locates the abutments 18 and 19 of block 50.

Block 50 has a concave end wall 15 to start a tandem row of block units 13 in a perpendicular direction (arrow 45) to the direction (arrow 47) of the row started by block 40.

Blocks 13, rods 30 and plugs 27 are made of materials standard in the trade.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A wall assembly comprising a plurality of repeating building blocks successively arranged in a tandem array within a row, said wall assembly comprising a number of rows, each stacked one above another, said tandem arrays within each row facing in an opposite direction with respect to an adjacent row stacked above and below thereto, for the purpose of enhancing lateral forces such as those produced during an earthquake, each building block of said array being generally rectilinear with the exception of two oppositely disposed distal end walls having arcuate, circumferential male and female mating surfaces, respectively, each arcuate, circumferential male and female mating surface having a radial diameter almost equal to a width of said block to further enhance resistance to said lateral forces, each end wall being rotatively engageable with an arcuate mating end wall of an adjacent block of said assembly at any desired angle of rotation within a limited range of arc defined by circumferential end abutments terminating said arcuate mating surfaces of said mating end walls, each male end wall having means defining a hole for receiving vertical reinforcement, each hole being in registry with a hole of a block of an adjacent row stacked above and below thereto, said vertical reinforcement still further enhancing said wall assembly to resist lateral earthquake forces.

2. The building blocks of said assembly of claim 1, wherein said arcuate end walls are approximately semicircular in shape.

3. The building blocks of said assembly of claim 1, having means defining a first aperture within a mid-portion thereof for receipt of a reinforcement plug.

4. The building blocks of said assembly of claim 3, further comprising a reinforcement plug disposed in said aperture, said reinforcement plug having means defining a lattice network of grooves for receipt of at least one reinforcing rod.

5. The building blocks of said assembly of claim 3, wherein said reinforcement plug has a substantially circular cross-section.

6. The building blocks of said assembly of claim 3, wherein said reinforcement plug has a lip limiting its depth within said aperture.

7. The building blocks of said assembly of claim 6, wherein said reinforcement plug has oppositely tapered surfaces disposed about said lip.

8. The building blocks of said assembly of claim 3, wherein said reinforcement plug has a tapered surface about is circumference for ease of insertion into the aperture of said building block.

9. The building blocks of said assembly of claim 3, having means defining a second aperture adjacent said first aperture and disposed within a male surfaced end wall.

10. The building block of claim 1, in combination with a mating corner block having a perpendicular corner shape.

11. The wall assembly of claim 1, in combination with mating corner blocks for forming perpendicular end walls.

* * * * *